US009623935B2

(12) United States Patent
Huenefeld

(10) Patent No.: US 9,623,935 B2
(45) Date of Patent: Apr. 18, 2017

(54) ARRANGEMENT FOR A SELF-PROPELLED WATERCRAFT SUPPORTED BY ARTICULATED CLUSTERS OF SPAR BUOYS FOR THE PURPOSE OF PROVIDING A MOBILE, WAVE MOTION-ISOLATED, FLOATING PLATFORM

(71) Applicant: John S. Huenefeld, Marysville, WA (US)

(72) Inventor: John S. Huenefeld, Marysville, WA (US)

( * ) Notice: Subject to any disclaimer, the term of this patent is extended or adjusted under 35 U.S.C. 154(b) by 0 days.

(21) Appl. No.: 15/156,163

(22) Filed: May 16, 2016

(65) Prior Publication Data

US 2017/0001690 A1 Jan. 5, 2017

Related U.S. Application Data

(60) Provisional application No. 62/187,646, filed on Jul. 1, 2015.

(51) Int. Cl.
*B63B 22/18* (2006.01)

(52) U.S. Cl.
CPC ..... *B63B 22/18* (2013.01); *B63B 2748/00* (2013.01)

(58) Field of Classification Search
CPC ..... B63B 22/18
USPC ..... 114/265, 266, 264; 405/203–205
See application file for complete search history.

(56) References Cited

U.S. PATENT DOCUMENTS 6,210,075 B1 * 4/2001 Korloo ..... B63B 1/048 166/345
6,425,710 B1 * 7/2002 Khachaturian ..... B63B 35/4413 405/200
6,435,773 B1 * 8/2002 Khachaturian ..... B63B 35/4413 405/202
6,692,190 B2 2/2004 Khachaturian
6,719,495 B2 * 4/2004 Khachaturian ..... B63B 9/065 405/200
7,703,407 B2 * 4/2010 Dunn ..... B63B 35/50 114/258
8,839,734 B2 * 9/2014 Khachaturian ..... B63B 9/065 114/258
9,506,451 B2 * 11/2016 Dehlsen ..... F03B 13/264
(Continued)

*Primary Examiner* — Lars A Olson
*Assistant Examiner* — Jovon Hayes
(74) *Attorney, Agent, or Firm* — Kathleen T. Petrich; Miller Nash Graham & Dunn LLP

(57) ABSTRACT

A mobile, wave motion-isolated, waterborne device having a platform with a plurality of support members extending beneath the platform configured to receive an articulated joint. The device further includes a plurality of corresponding clusters of spar buoys, wherein each spar buoy has an articulated joint at a first end of the spar buoy and a ballast operably configured at the second end. The articulated joint of each spar buoy within the cluster corresponds to a swivel footing configured to receive an articulated joint. The swivel footing itself includes an articulating joint. Each articulated joint of the swivel footing corresponds to one of the support members of the platform. The cluster of spar buoys can optionally move between a vertical orientation and a horizontal orientation. An optional movable ballast may be used in place of a stationary ballast. The invention also includes optional thrust/propulsion, steering, and damping features.

20 Claims, 24 Drawing Sheets

(56) References Cited

U.S. PATENT DOCUMENTS

| | | | | |
|---|---|---|---|---|
| 2004/0037651 | A1* | 2/2004 | Khachaturian | B63B 9/065 405/203 |
| 2011/0209875 | A1* | 9/2011 | Crome | E21B 43/0107 166/339 |

* cited by examiner

ARRANGEMENT FOR A SELF-PROPELLED WATERCRAFT SUPPORTED BY ARTICULATED CLUSTERS OF SPAR BUOYS FOR THE PURPOSE OF PROVIDING A MOBILE, WAVE MOTION-ISOLATED, FLOATING PLATFORM

RELATED APPLICATIONS

This application claims priority to U.S. provisional patent application Ser. No. 62/187,646 filed on Jul. 1, 2015, the contents of which are fully incorporated herein by reference.

TECHNICAL FIELD

The present invention relates to a mobile wave motion-isolated waterborne device including platforms of any size, operably connected to articulated clusters of spar buoys through swivel footings. The spar buoys may be optionally self-propelling, include a steering mechanism, and/or moveable between vertical and horizontal positions.

BACKGROUND OF THE INVENTION

Many types of marine platforms are covered in patent literature. Buoys, and in particular, spar buoys, have been used in many ways either as free floating markers or to support small and large loads. See e.g., U.S. Pat. Nos. 6,425,710 B1 and 6,719,495 B2.

Free floating and mobile marine platforms employing spar buoys for support may be used in the conduct of numerous kinds operations at sea. Buoys with the described deep water thruster arrangement for self propulsion, the arrangement of swinging ballast for the purpose of transitioning the buoy from horizontal to vertical orientation and back again, as well as the clustering spar buoys under an articulated footing to support a mobile platform, are not seen in any prior disclosure.

SUMMARY OF THE INVENTION

The invention is directed to mobile, wave motion-isolated, waterborne devices and vessels. Each device and vessel includes a platform having an upper and lower surface with a plurality of support members projecting beneath the lower surface. A plurality of swivel footings are positioned beneath the support members. Each swivel footing corresponds to a support member. Each swivel footing has a central pivot with an articulating joint that is configured to be received within a base of each support member. Each swivel footing is configured to receive a plurality of articulating joints that are radially spaced apart from the central pivot.

A plurality of spar buoys are configured to be received into the swivel footing so that the spar buoys are radially clustered about the central pivot. Each spar buoy has a first end, a tubular shell, and a second end. The first end of each spar buoy includes an articulating joint that is received within the swivel footing. The second end is operably connected to a ballast.

Various forms of articulating joints are envisioned within the scope of the invention, including a ball and socket articulating joint, a gimbal joint, a universal joint, and a spherical bearing joint.

According to one aspect of the invention, each swivel footing may include radially extending arms with two ends. One end of the arm is connected to a hub including the central pivot. The other end is configured to receive an articulating joint attached to the first end of the spar buoy.

According to other aspects of the invention, the ballast may be moveable and provide rotational movement in order to move the associated spar buoy between a vertical orientation and a horizontal orientation. With multiple movable ballasts, an entire cluster of spar buoys may reposition from a vertical (generally downward orientation relative to the surface of the water to which the platform floats) to a horizontal position tucked underneath or substantially underneath the platform.

Thrust/propulsion modules may be added to one or more spar buoys to allow the device or vessel to self propel in water applications and not require towing. In one form of the invention, a propulsion module wraps around a shell of a spar buoy. The propulsion module may include a housing containing an impeller and one or more nozzles that may be configured to articulate through an angle of 90 degrees.

Vessels and devices vary primarily of scale. Vessels are designed to be larger and support bigger and/or heavier loads atop its platform. Both devices and vessels can include the thrust/propulsion modules discussed above, as well as an optional steering mechanism and optional damping fin assembly that correspond to at least one spar buoy per cluster. The damping fin assembly can reduce undesired oscillations along the vertical axis of the corresponding spar buoy.

These and other advantages are discussed and/or illustrated in more detail in the DRAWINGS, the CLAIMS, and the DETAILED DESCRIPTION OF THE INVENTION.

BRIEF DESCRIPTION OF THE DRAWINGS

Like reference numerals are used to designate like parts through the several views of the drawings. The accompanying figures, which are incorporated herein and constitute a part of this specification, illustrate various exemplary embodiments.

DETAILED DESCRIPTION OF THE INVENTION

Figure 1:
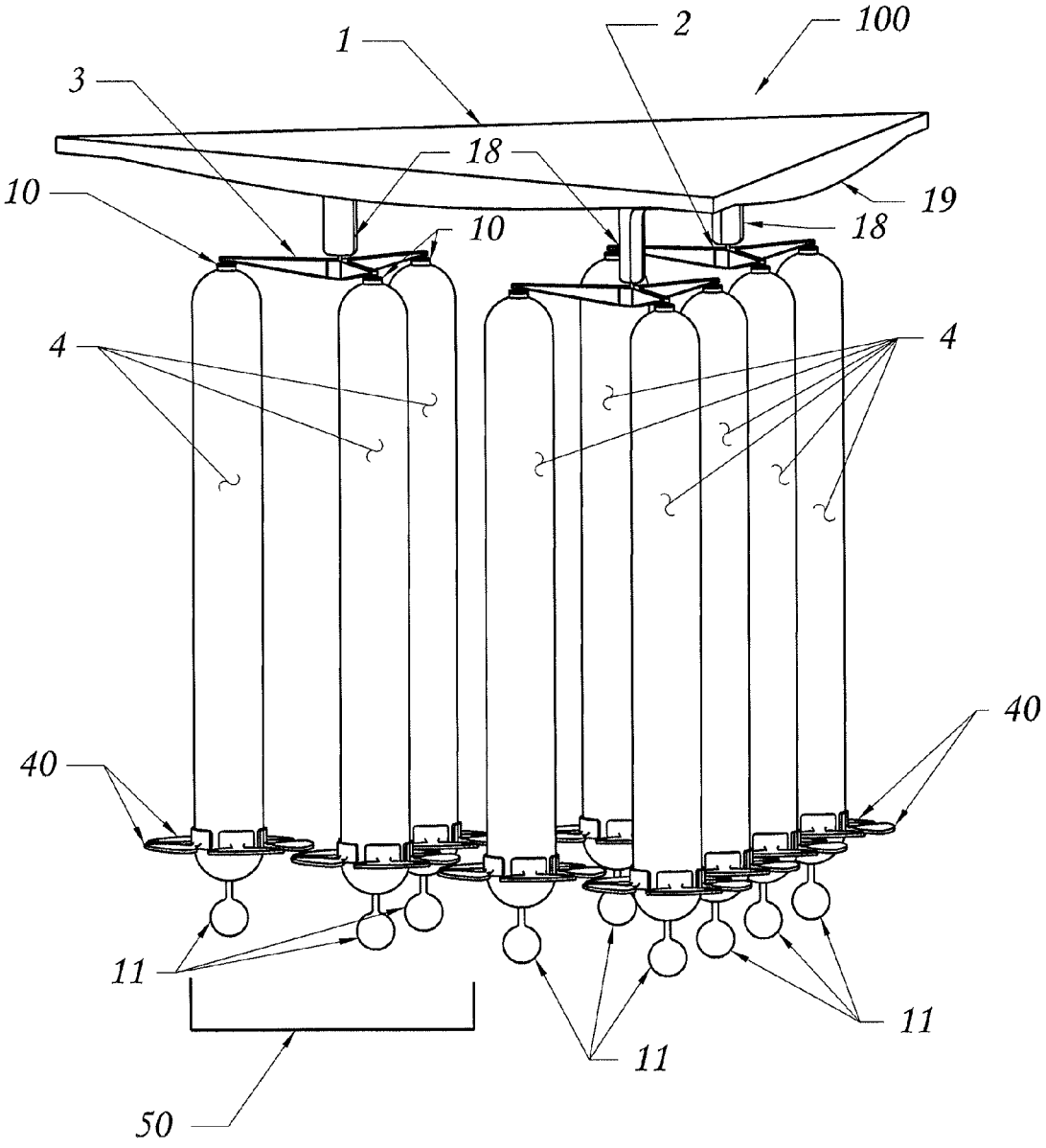
FIG. 1 is a perspective view of a first embodiment illustrating a wave isolated upper platform, an upper level of articulation, and one or more swivel footings supported by a plurality of articulating clustered spar buoys with each spar buoy including a ballast and an optional damping fin assembly.

The present invention relates to mobile wave isolated waterborne platform devices of any size that may be useful for the conduct of operations requiring a low motion environment, (minimal pitch and roll) while at sea, or upon any body of water large enough to develop significant waves. While any vessel or marine platform may be anchored, including this invention, the self-propelled embodiment of this invention provides greater flexibility of operations for the purpose of navigation or station keeping while retaining the option of using anchors.

Referring to FIGS. 1-9, a first embodiment of the device 100 includes a wave isolated upper platform 1, an upper level of articulation 2, and three or more swivel footings 3, with each swivel footing supported by a plurality of articulating clusters (50) of spar buoys 4.

Each spar buoy 4 is an elongated tubular shell 5 having a first end 6, which may also be referred to as a top in a vertical position, and a second end 7, which may also be referred to as the base. The top of each spar buoy 4 is closed with a cap 8 having a pivot 9, together which may be referred to herein as a pivot cap 10. The base of each spar buoy 4 is operably connected to a ballast 11. Tubular shell 5 may be made of any suitable rigid material capable of resisting water intrusion. Spar buoy 4 may be small or large, depending on the application and the size of the associated platform. Large spar buoys could be constructed economically from marine grade, reinforced concrete.

Ballast 11 may be made of a material of high density. Ballast 11 is operably connected to base 7 externally or internally (not illustrated) of its associated spar buoy 4.

Spar buoys, as illustrated, are of circular cross section but they may be of any closed shape projected along an axis. Ballast 11 has been illustrated as a spherical mass but may be sculpted to a hydrodynamic form which may assist in reducing drag while the vessel is underway in either the upright or retracted configuration. The mechanism for relocating the ballast has been illustrated as a simple swinging lever, however, a track mounted system, or a cable drawn system, or other means of creating the required displacement may be employed.

Swivel footings 3, 3', 3", and 3''', as illustrated in FIGS. 3-6, include a plurality of arms 12 that are equally spaced apart about a central pivot 13. Footing configurations with three, four, five, six arms, or more, are encompassed as part of the invention. Each arm 12 includes a first end 14 that is operably connected to central pivot 13 and a second end 15 that is operably connected to pivot cap 10 of a corresponding spar buoy 4.

Footings 3 have been illustrated as star-like shapes with arms radiating from a central hub, however, they could easily be circular discs, rectangular blocks, or any other shape having multiple pivot attach points for support from three or more buoys and a single main pivot point for support of a higher platform. When equipped with a propulsion module (or thruster) 29 (see FIGS. 15-17), the footing may include a mechanism for the directional control of the thrust not shown in the figures.

Figure 8:
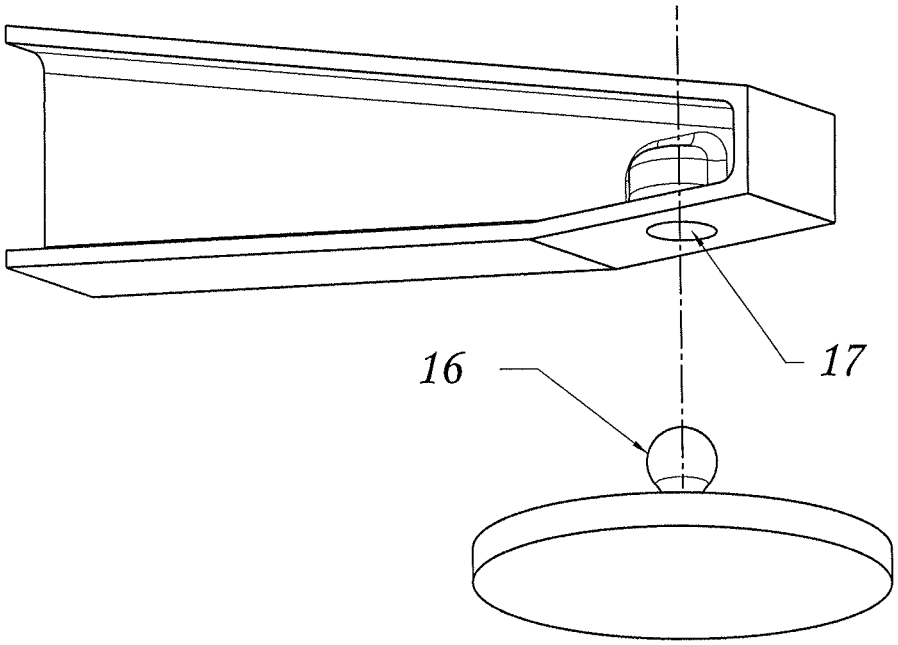
FIG. 8 is an enlarged perspective view of ball and socket articulating joint disclosed in FIG. 1.

Ball and socket articulating joint attachment means are illustrated in FIGS. 1-8 to operably connect a ball member 16 of central pivot 13 of each of the three or more swivel footings 3, 3', 3", 3''' to an associated socket 17 on platform 1 such as socket member illustrated in FIG. 8. In one form of the invention, the associated socket 17 is positioned at an end of a support member 18, which may be a stiff leg, attached to platform 1 beneath platform 1's lower surface 19. The number of stiff legs corresponds to the number of swivel footings. Each socket on the stiff leg is configured not to transmit rotational forces, and, therefore no rotational forces are transmitted to the platform. Other articulating joint methods are discussed further below.

Figure 2:
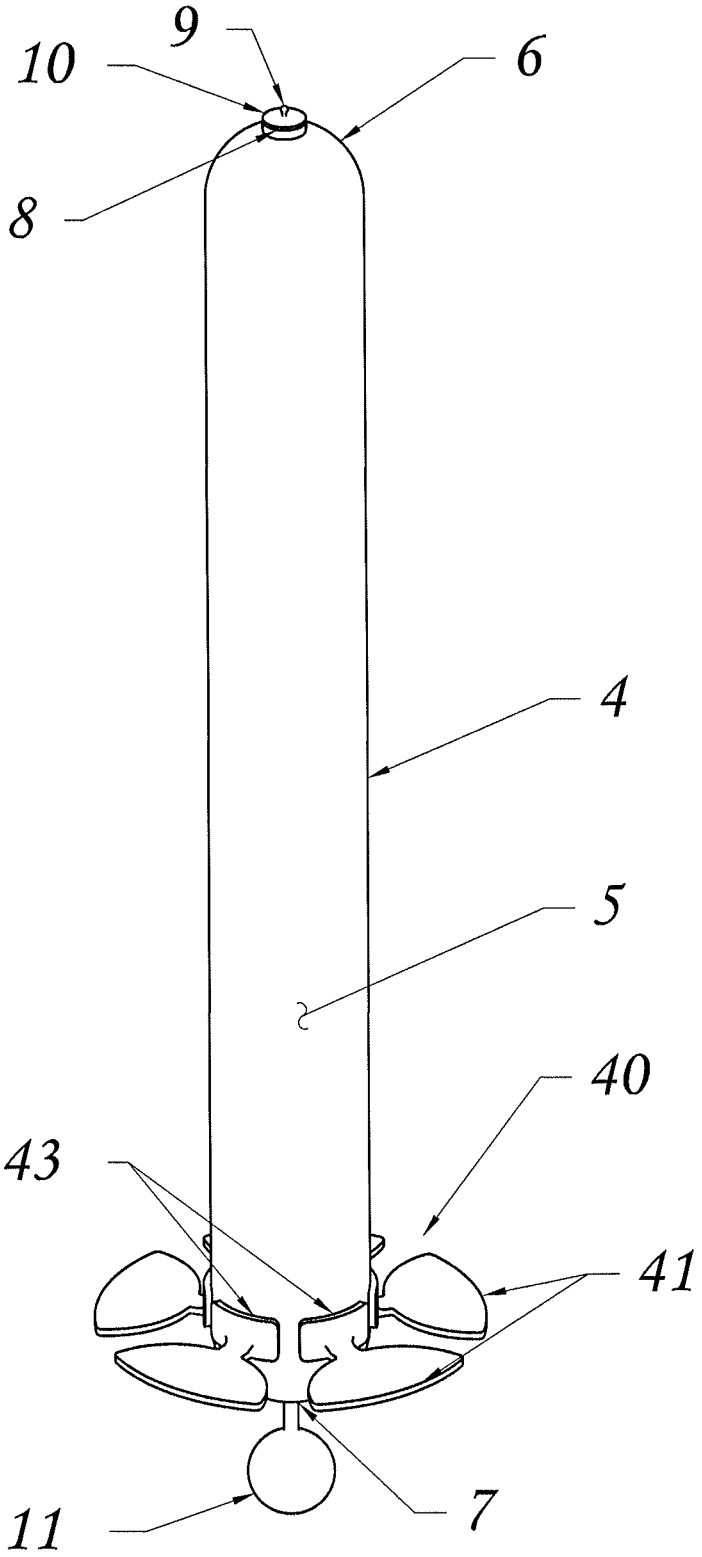
FIG. 2 is an enlarged view of the spar buoy of FIG. 1 better illustrating a tubular shell having a first end with a pivotable attachment and a second end operably connected to a ballast.
Figure 3:
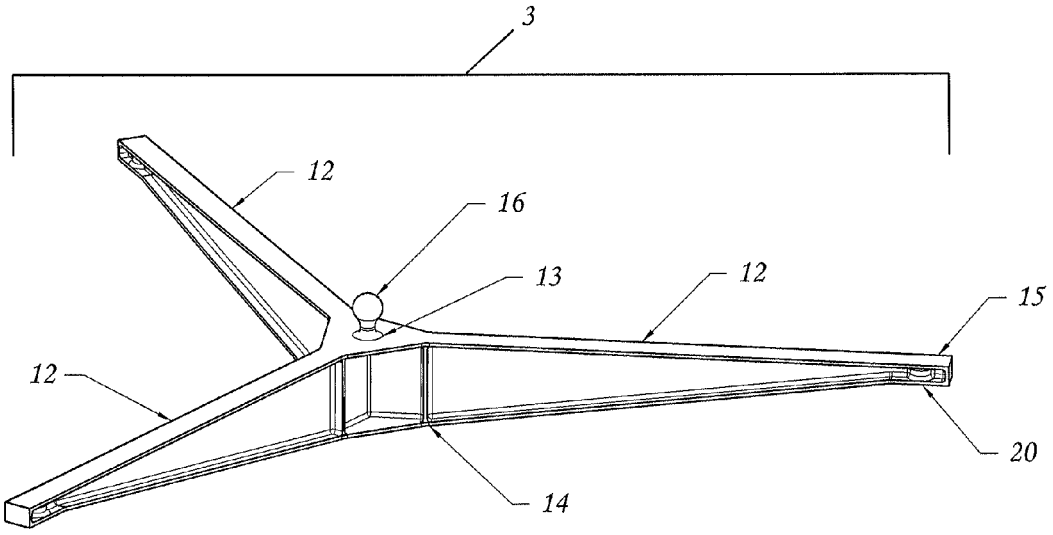
FIG. 3 is an enlarged perspective view of a representative swivel footing of FIG. 1 illustrating a plurality of arms spaced apart and a central pivot.
Figure 4:
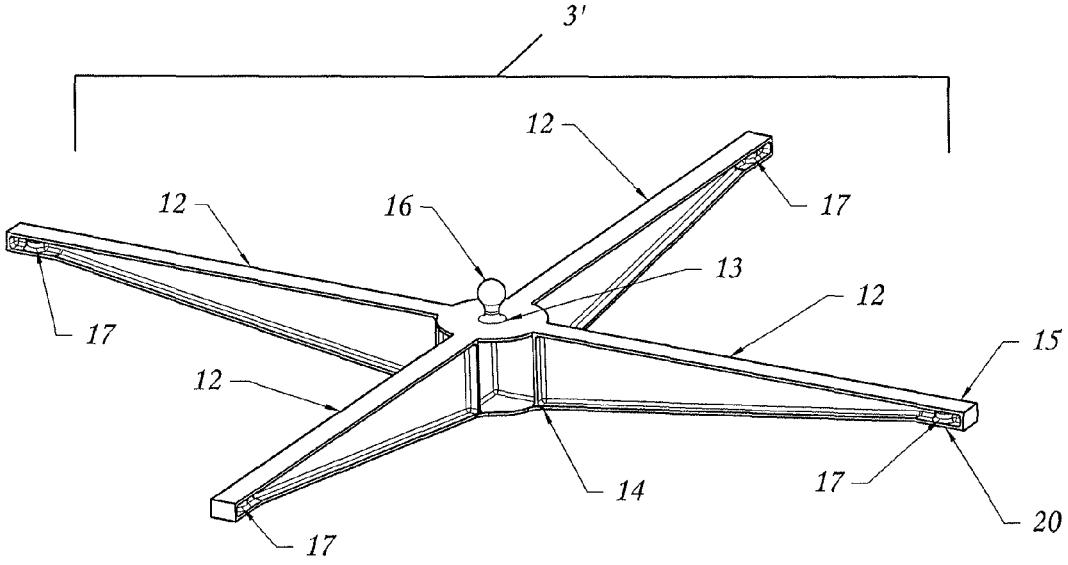
FIGS. 4-6 are perspective views of alternative embodiments of the swivel footings illustrating various multiple arm configurations.
Figure 5:
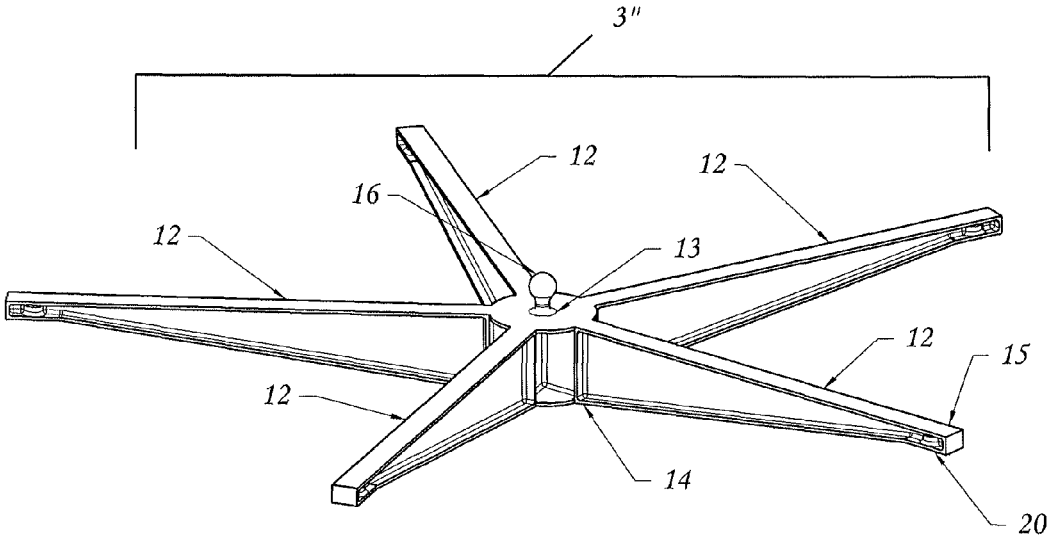

Referring particularly to FIG. 2, ball and socket attachments may also be used to attach the pivot cap of each spar buoy to the second end of each footing similar to the attachment method between the swivel footings and the platform. A ball fitting may be positioned atop of the cap 8 to function as the pivot 9. A corresponding socket 20 may be positioned beneath each footing arm 12 at each second end 15. The pivot attachments between the buoys and footings and the footings and the platform may be of any configuration that transmits limited rotational force and allows free movement of the buoys, footings, and platform. Other attachment methods may also be used and are discussed further below.

A spar buoy's natural oscillation period may be calculated using equation 1.

$$T=2\pi\sqrt{M/A\rho G} \quad (1)$$

Where T is the time period of one oscillation, M is the mass of the buoy/load combination, A is the cross sectional area of the buoy, ρ is the density of the fluid medium (sea water) and G is the gravitational attraction of the Earth at sea level.

The study of vibration response is a well documented and complex science. In simple terms, if the natural oscillation period of a system is more than 1.7 times the period of the forcing function (sea waves) the system will not resonate and will respond marginally to the forcing function. So for waves with five seconds between crests such as found in the Gulf of Mexico, a buoy should have a natural period of 8.5 seconds or higher. For wave sets with 10 seconds between crests, the buoy should have a natural period of 17 seconds or higher. The period T in equation 1 may be increased by either increasing the mass M or decreasing the area A or may be decreased by doing the opposite.

Response to waves may also be decreased by spreading the buoys and buoy clusters so that they will each ride a different part of the wave. The displacement of the center pivot of a footing will be the average of the individual buoy displacements, thus if some buoys, or clusters are riding up a wave while other are riding down, the average will tend toward being neutral.

The velocity of sea waves is given by equation 2, where L is the wave length and T is the period.

$$v=1.25\sqrt{L} \text{ or } v=L/T \tag{2}$$

A little algebra yields equation 3.

$$L=(1.25T)^2 \tag{3}$$

Knowing the wave length allows the buoys to be positioned so that they will be out of phase with the other buoys. The angle of phase may be computed by equation 4 where L is the wave length and D is the distance between buoys.

$$\text{Phase Angle } \theta = 360\left(\frac{D}{L}\right) \tag{4}$$

Values of D/L of 0.333 or higher will ensure that the inputs from individual buoy response do not interfere constructively.

Figure 6:
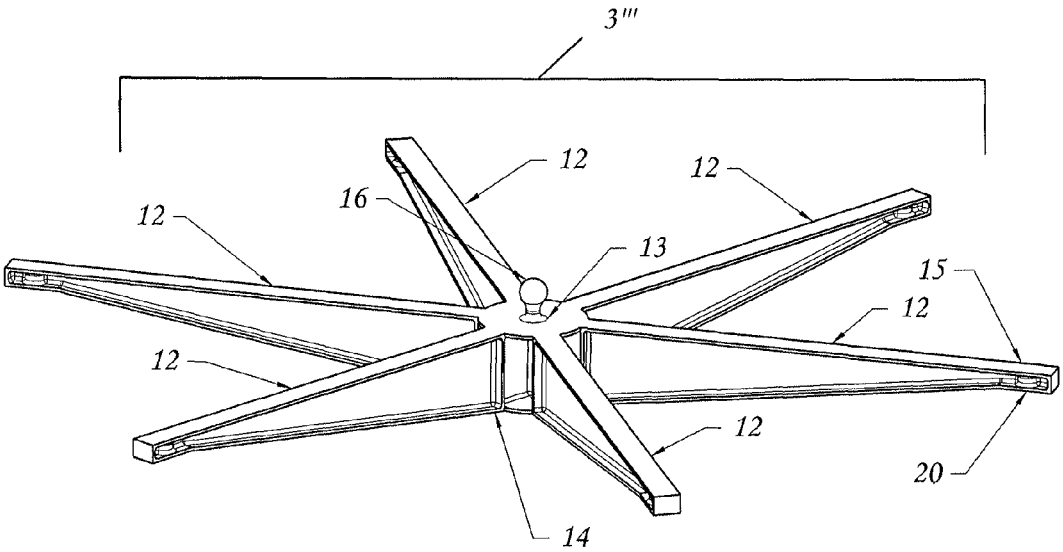
Figure 7:
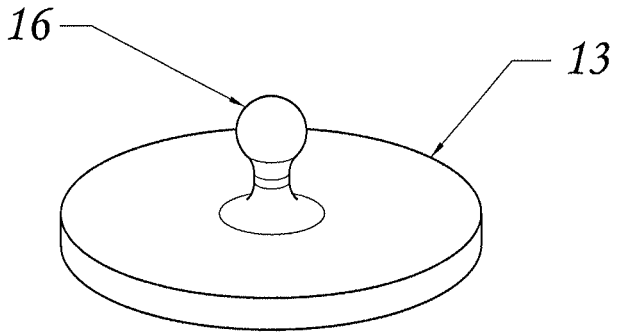
FIG. 7 is an alternate and enlarged embodiment of the central pivot of FIG. 3 and better illustrating a ball fitting that is configurable to a corresponding socket operably configured to the platform of FIG. 1.

Additional layers articulation may be added by the insertion of footings between the platform and the first level footings for increased wave isolation. The platform in FIG. 1 would be replaced by a larger footing supported by the lower spar buoy clusters. The top platform is then supported by a minimum of three second level footings. The minimum such arrangement requires a top platform, three second level footings, nine first level footings, and twenty-seven individual spar buoys. Theoretically any number of layers of articulation is possible; however economics and logistics will restrict the number of such layers in actual applications. Furthermore, each cluster may have four, five, six, or more spar buoys to provide additional support to the footing. Footings with up to six arms are shown in FIG. 6. The spar buoys may be of equal dimensions, equally spaced around the center of rotation of the footing, or may be of differing dimensions, unequally spaced on arms of differing lengths in order to tailor the footing vibration response to the wave motion of the water surface. In such an arrangement it is desirable to have the combined center of buoyancy of the buoys supporting a footing aligned beneath the center of rotation of that footing.

Figure 9:
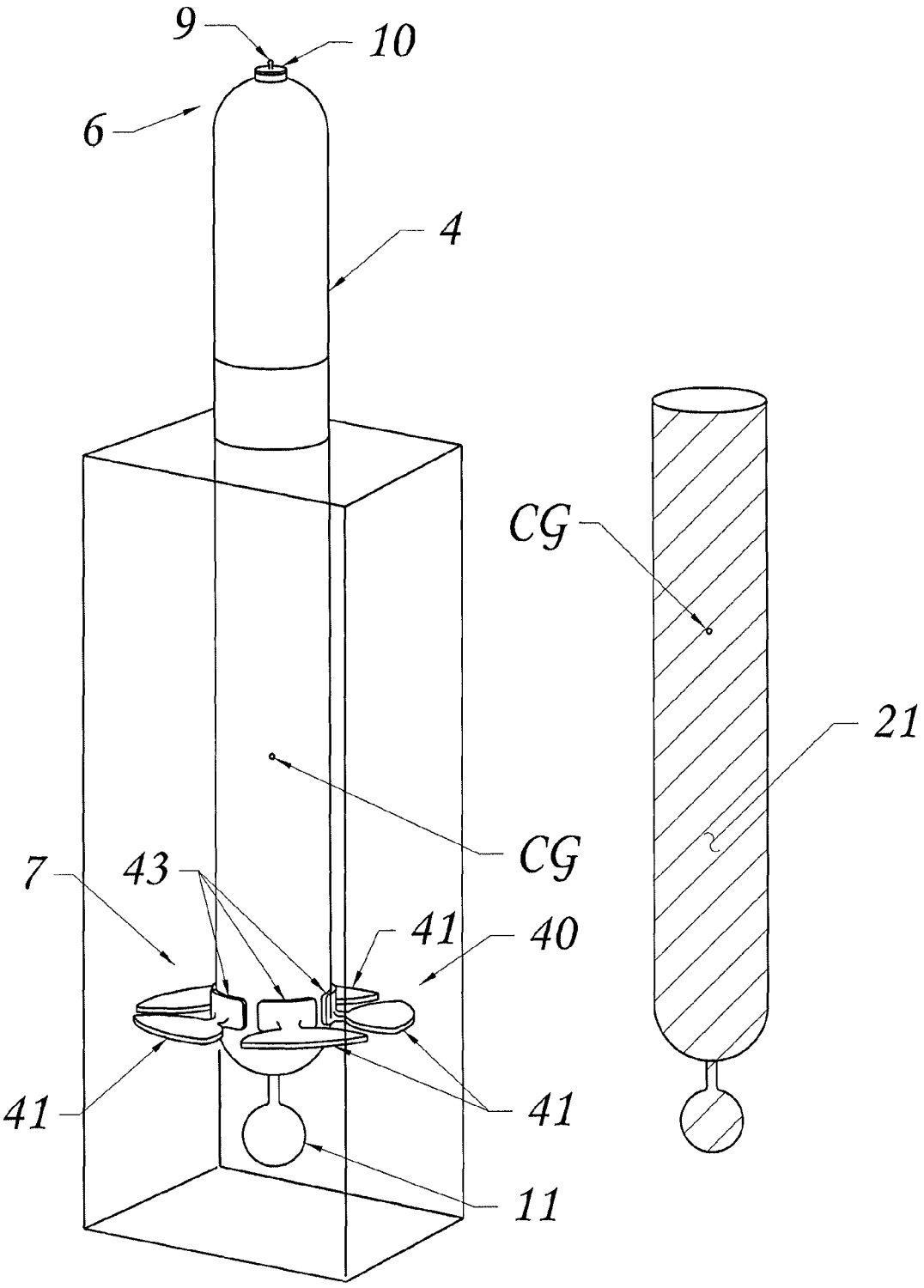
FIG. 9 is a schematic view illustrating the dynamics of the spar buoy arrangement where the buoy is supported by an amount of displaced water equal to its mass.

Referring now to FIG. 9, the dynamics of the spar buoy arrangement are illustrated where the spar buoy 4 is supported by an amount of displaced water 21 equal to its mass. This displacement is the equilibrium point that establishes the natural water line. The buoy will float upright as long as the center of gravity (CG) of the buoy-ballast combination lies below the CG of the displaced water. The distance the CG of the buoy is below the CG of the displaced water defines a zone of stability. Load may be applied to the top of the spar buoy which will cause it to sink further and displace additional water equal to the mass of the load applied. The load applied to the top of the buoy will have the effect of raising the CG of the buoy-ballast-load combination. As long as the CGs are separated by the zone of stability, the buoy with applied load will remain upright. Every ballasted buoy arrangement, as illustrated, will oscillate or bob about the water line at a frequency defined by its mass and cross sectional area. This invention tailors the buoy dimensions to negate response or to respond minimally to inputs of expected water wave frequencies.

Figure 10:
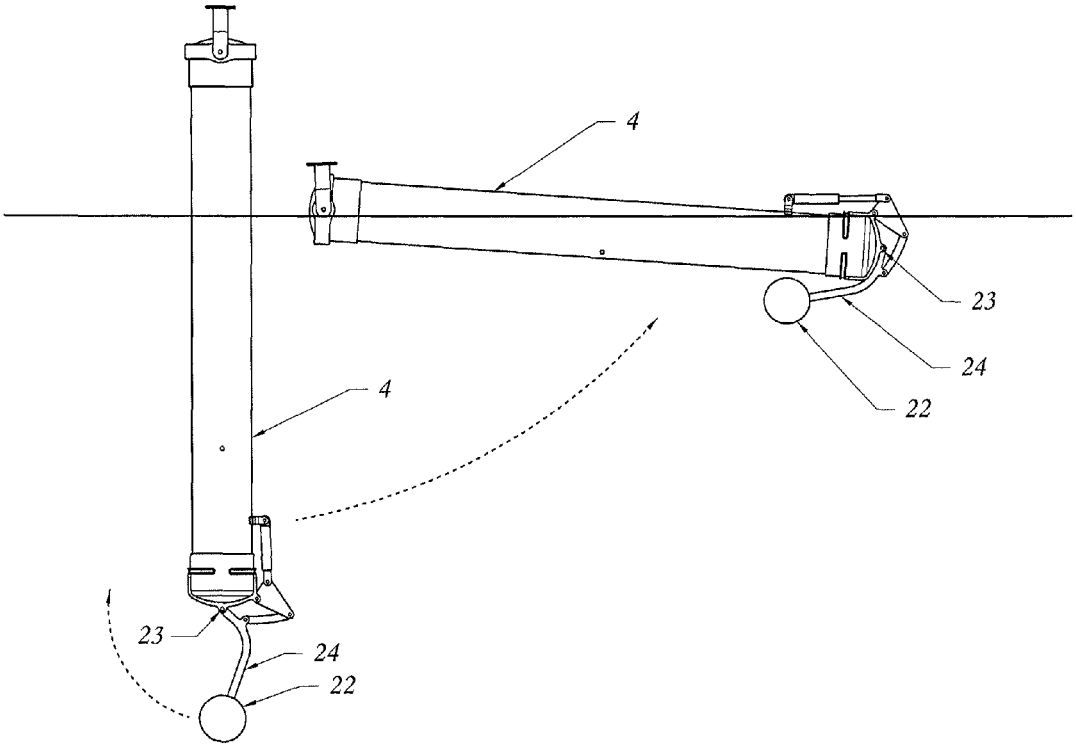
FIG. 10 is a schematic view illustrating the spar buoy, here with a movable ballast, able to transition between vertical and horizontal floating positions.
Figure 11:
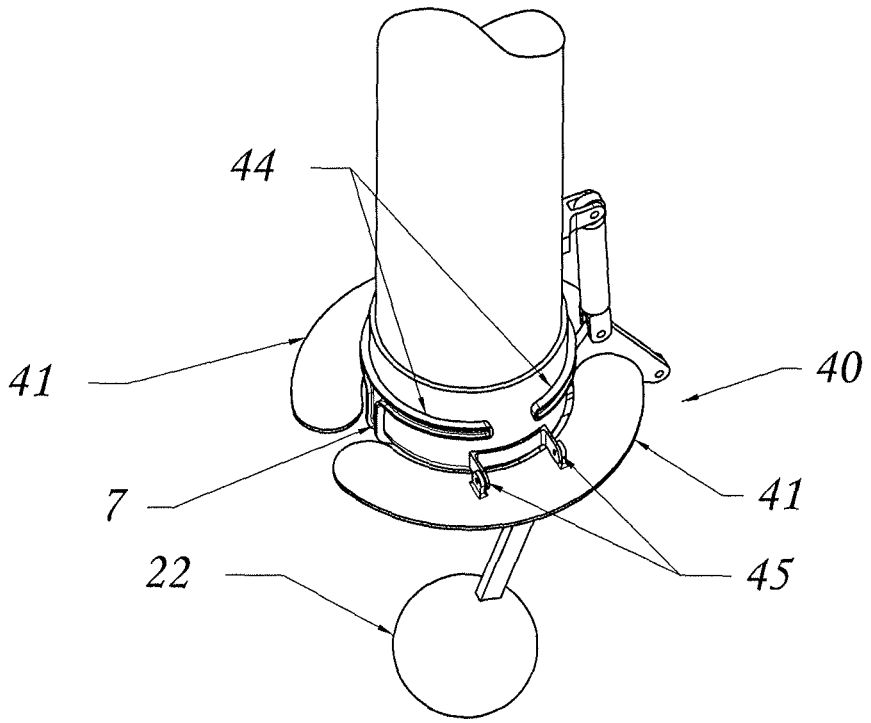
FIG. 11 is an enlarged perspective view of the moveable ballast of FIG. 10 with optional damping fin assembly.

A second embodiment of the invention is illustrated in FIGS. 10 and 11 where spar buoy 4 includes a movable ballast 22 that is configured to transition between a vertical floating position and a horizontal floating position and back again. Moveable ballast 22 moves about a pivot point 23. The motion is created by a lever arm mechanism 24 which may be powered from platform 1 by a mechanical pulley, drive shaft, hydraulic, or electrical means. The displacement of ballast 22 in FIG. 10 may appear insufficient to cause buoy transition between the two positions, however, this is a non-obvious feature of this invention and depending on the load applied to the top of the buoy even smaller displacements may suffice. Other buoys with retractable ballast able to transition between upright and horizontal positions appear in patent literature, however none of them are intended to be used repeatedly and none displace the ballast laterally in a swinging motion. The lateral displacement mechanism provides control of the direction the buoy will rotate while in transition and provides stability in floating orientation after the transition is complete.

Figure 12:
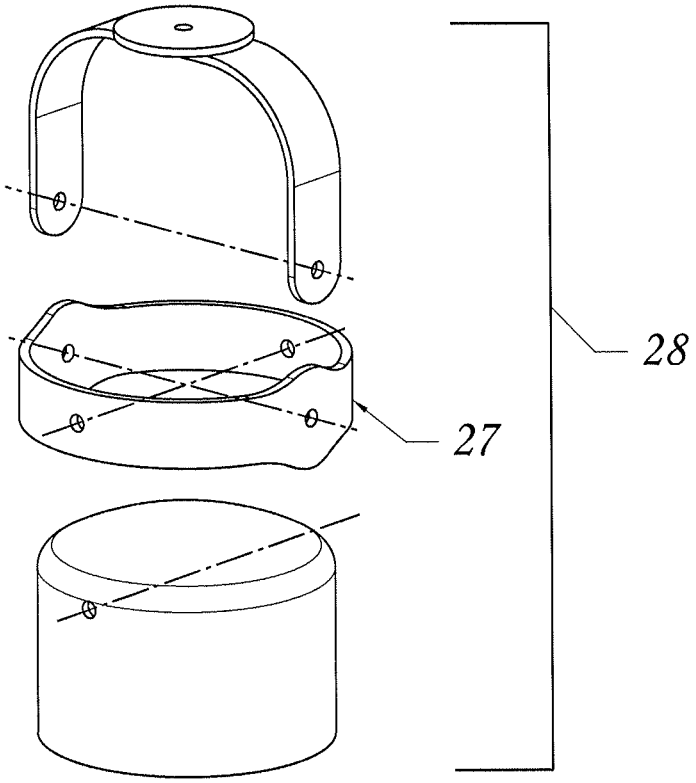
FIGS. 12-14 are perspective views of various alternative articulating joints for use between the buoys and their respective footings or between the central pivot of the footings and higher footings or the upper platform stiff legs.
Figure 13:
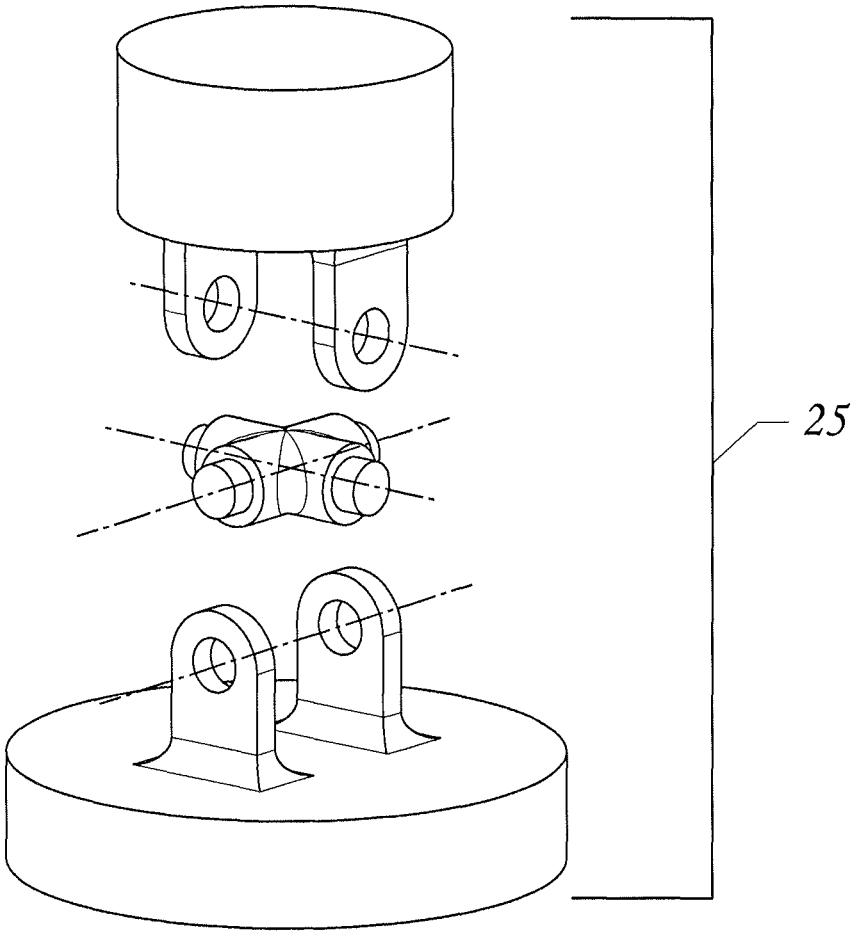
Figure 14:
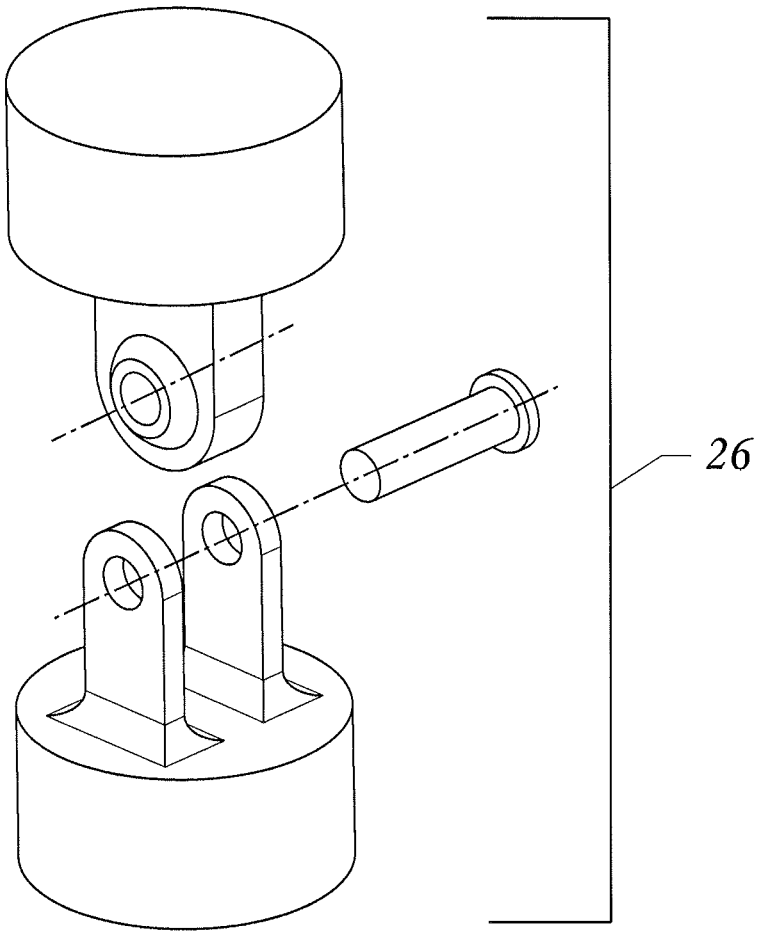

Referring now to FIGS. 12-14, various alternate articulated joints (attachment methods) for use between spar buoys 4 and their respective footings 3 or between central pivot 13 of footings 3, 3', 3", 3''' and platform support member 18. These joints generally do not transmit rotational forces, thereby allowing free movement between the buoy and the footing or the footing and the platform. The amount of rotation allowed varies for each type, however, each may be modified to allow buoy transition between vertical and horizontal orientation. A universal joint 25 (FIG. 13) and the spherical bearing 26 (FIG. 14) may require an additional rotation joint similar to swivel plate 27 shown on the gimbal joint 28 (FIG. 12) to allow the buoy to rotate about its longitudinal axis. FIG. 10 illustrates use of the gimbal articulated joint of FIG. 12.

Figure 15:
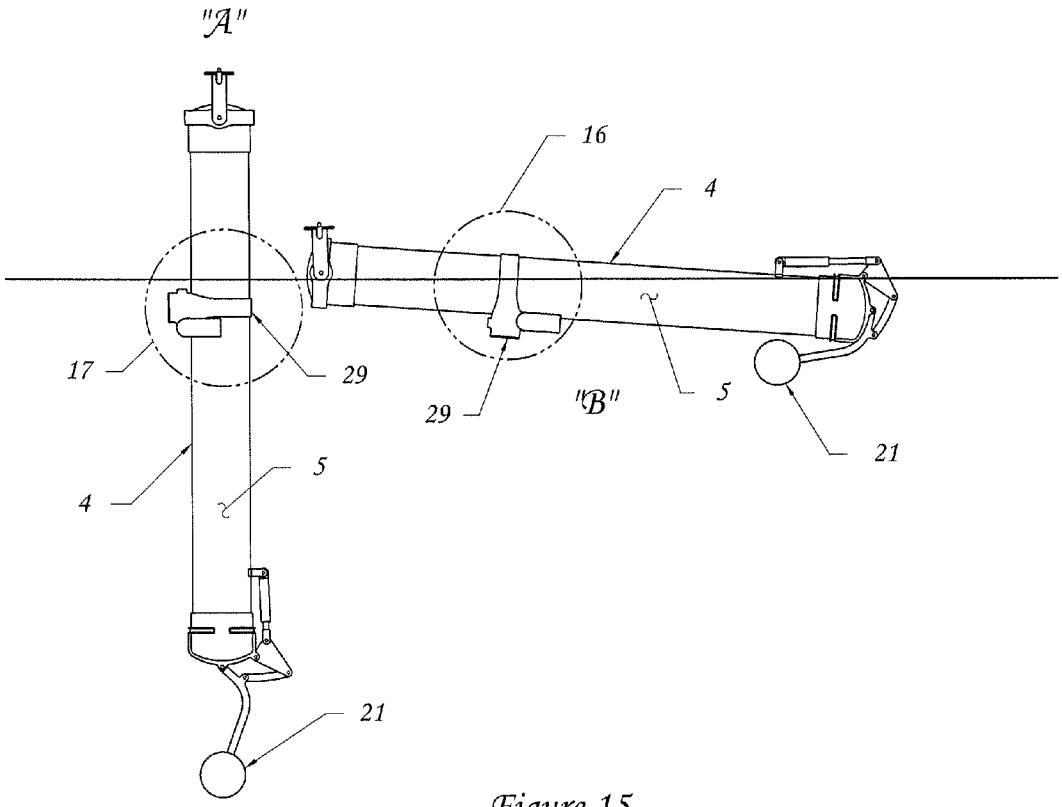
FIG. 15 is a schematic view of a buoy propulsion system with a wrap-around propulsion module, able to transition between vertical and horizontal floating positions.
Figure 16:
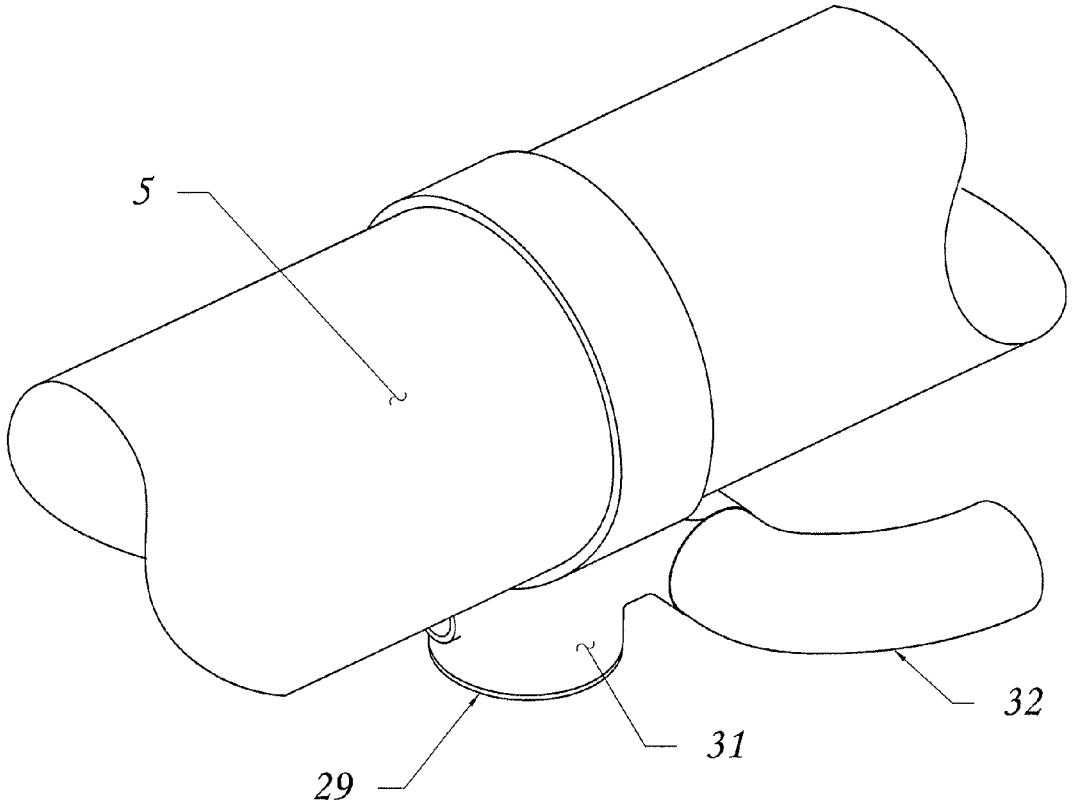
FIG. 16 is a perspective view of the wrap-around propulsion module of circle 16 of FIG. 15.
Figure 17:
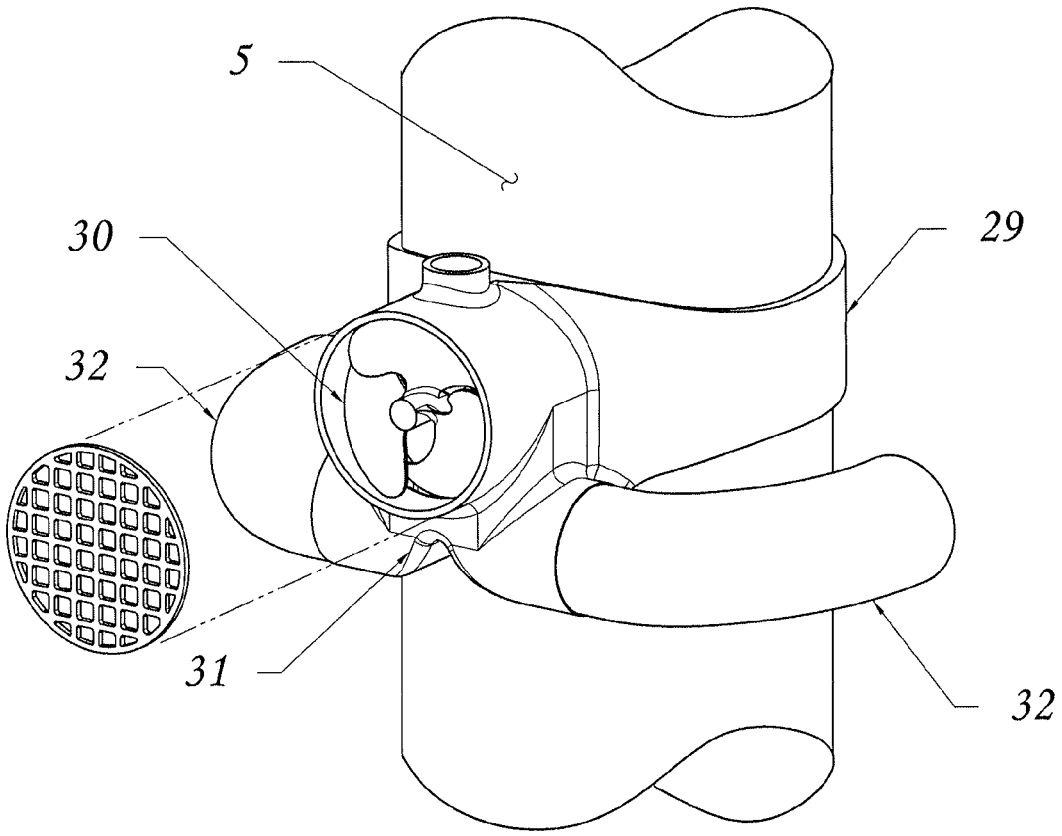
FIG. 17 is a perspective view of the wrap-around propulsion module of circle 17 of FIG. 15 with the grate removed to better illustrate the impeller.

Referring now to FIGS. 15-17, buoy propulsion is illustrated. A wrap-around propulsion module 29 attaches to spar buoy 4 without penetrating spar buoy shell 5. The intake is positioned on the forward side of the spar buoy below the waterline and will remain below the waterline when the buoy transitions from vertical (A) to horizontal (B) positions. An impeller 30 is mounted in a main housing 31 and forces water to flow around the buoy and out through jet nozzles 32, creating thrust. The nozzles may articulate through an angle of 90 degrees so that the thrust may be directed aft in both positions A and B. The impeller may be powered by a drive shaft, hydraulic lines, or electrically.

Figure 18:
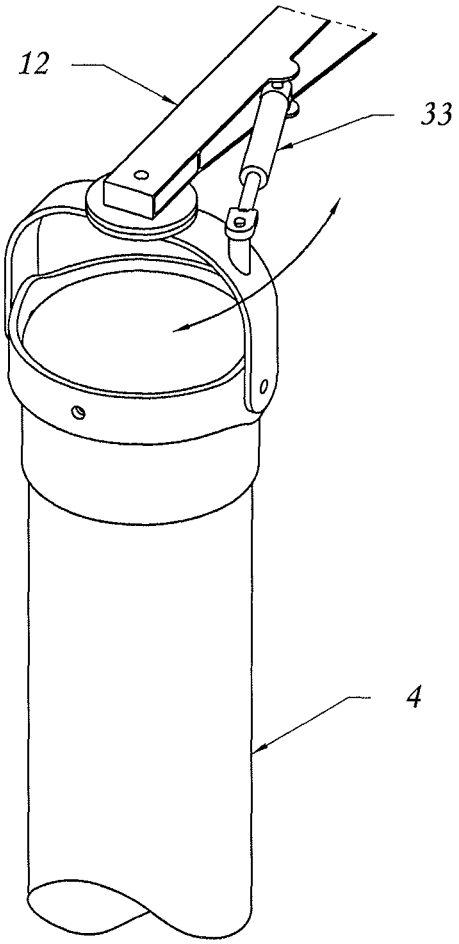
FIG. 18 is a perspective view of a spar buoy outfitted with a steering mechanism including a push rod operably connected to the articulate joint of FIG. 10.
Figure 19:
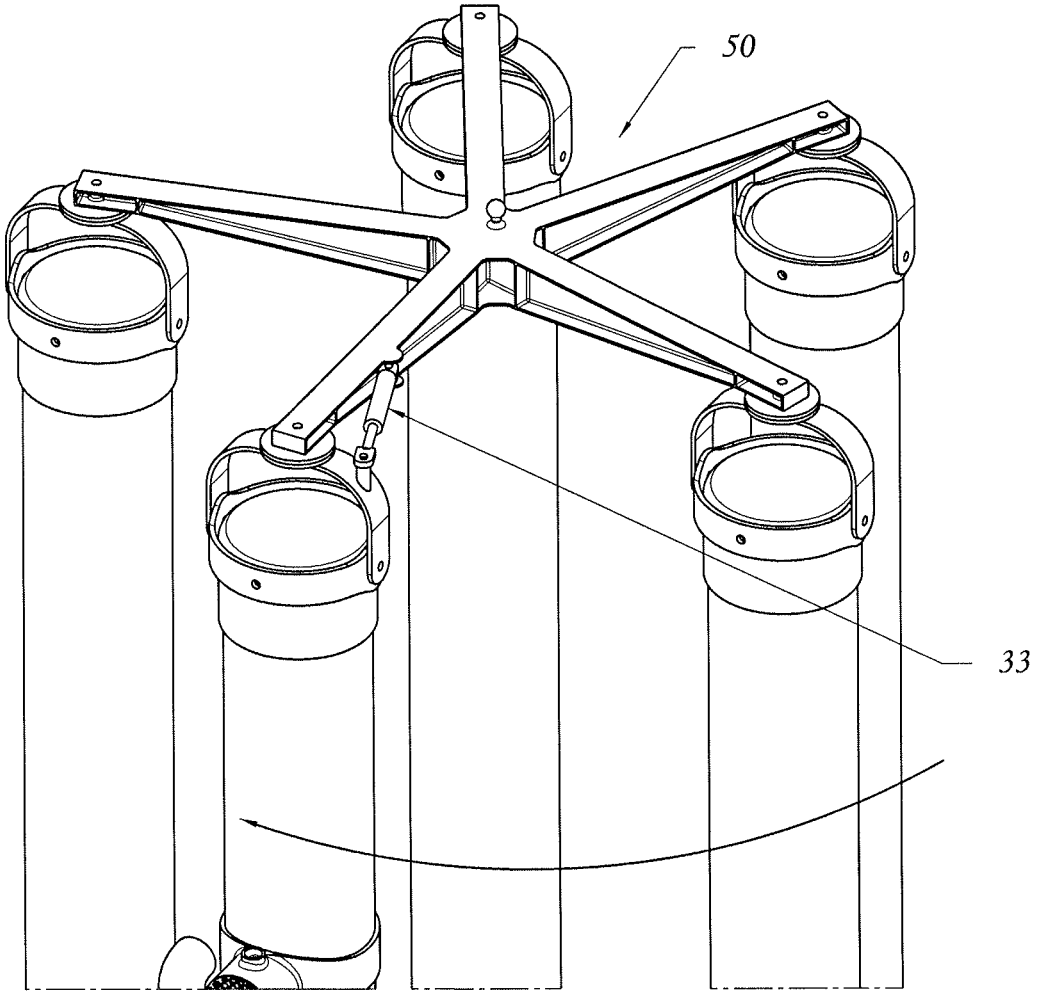
FIG. 19 is a perspective view of the spar buoy and steering mechanism of FIG. 18 in context to its cluster and associated swivel footing.
Figure 20:
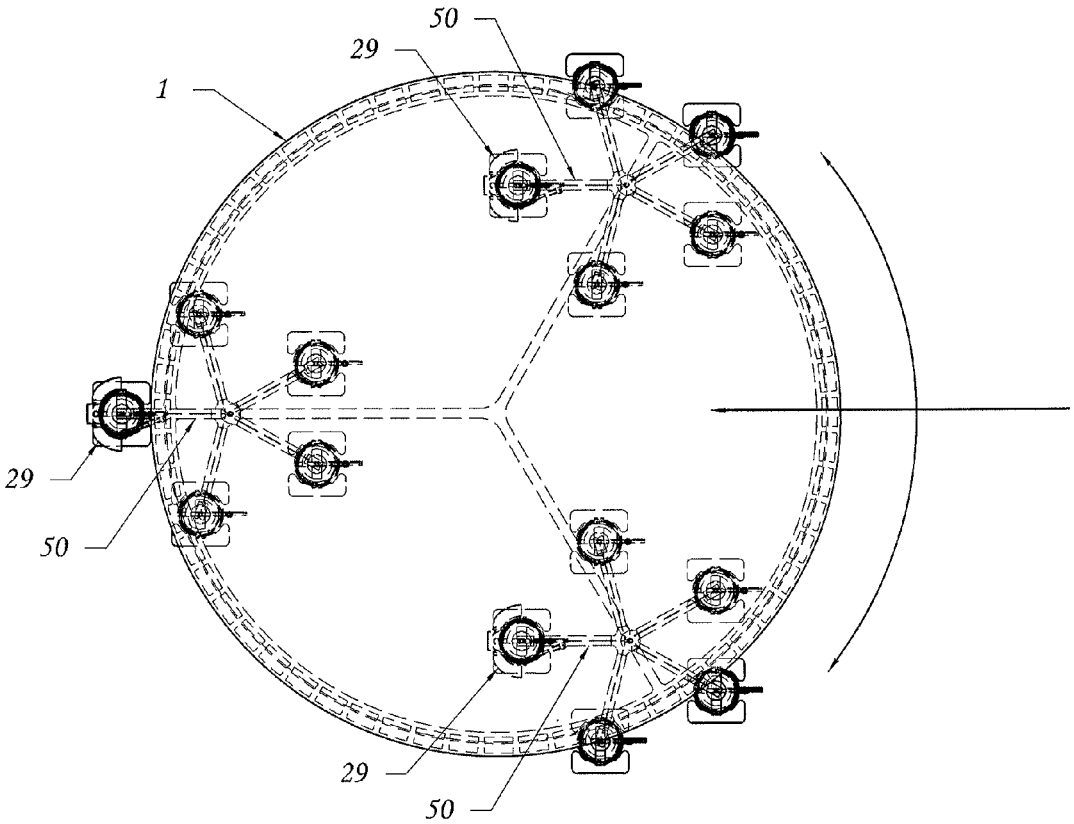
FIG. 20 is a top view looking down upon a platform illustrating three sets of spar buoy clusters and their associated swivel footings, where each cluster includes a propulsion module of FIG. 16.

FIGS. 18-20 illustrate various steering mechanisms. Directional control is achieved by means of an actuator or push rod 33 that causes the buoy equipped with a thruster pack (propulsion module) 29 to rotate about its longitudinal axis. This, in turn, will cause the buoy cluster to rotate about its central axis. When the cluster is aligned in the direction of desired motion, the actuator returns the thrust buoy to the neutral position. When all clusters are aligned in the same direction, the vessel will move in a straight line. This system allows the vessel to move in any direction without the need to rotate the main platform. Aligning the clusters to thrust in different directions will cause the upper platform to rotate. If all thrusting clusters are aligned in a tangential pattern, the vessel may be made to rotate in place without any lateral motion. Combinations of alignments in between those listed above may be used to create rotational and forward motion simultaneously. Such motions may be useful for sightseeing tours.

Figure 21:
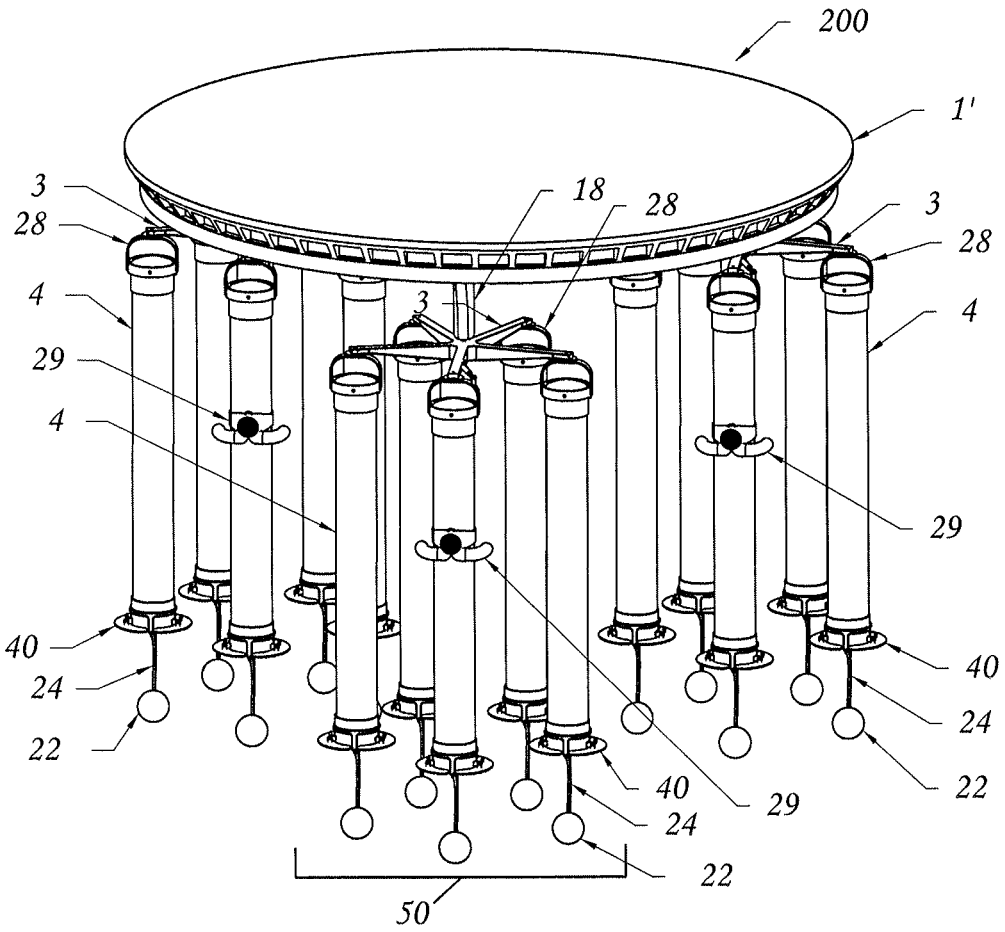
FIG. 21 is a perspective view illustrating an upright vessel configured with three spar buoy clusters having five spar buoys per cluster.
Figure 22:
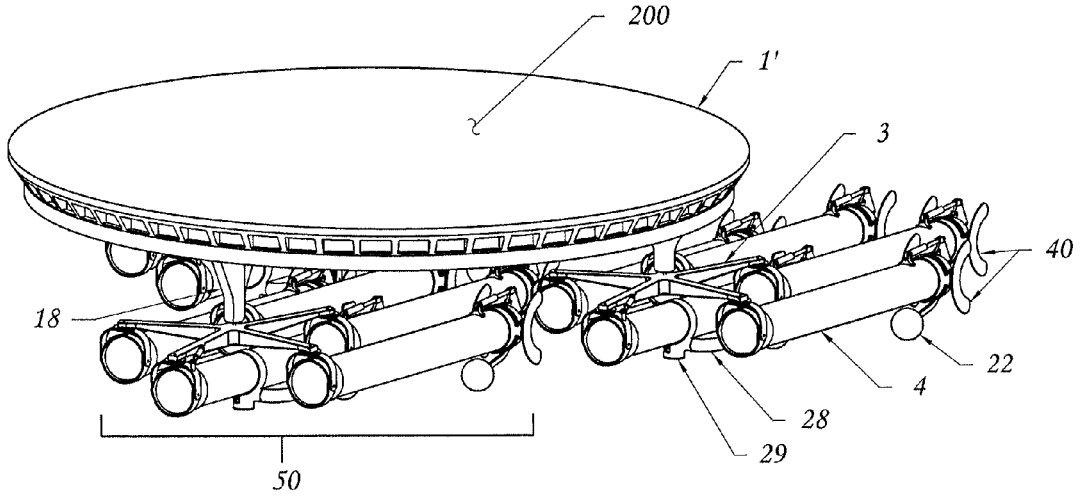
FIG. 22 is a perspective view illustrating the vessel of FIG. 21 in the retracted position.

Referring now to FIGS. 21 and 22, a vessel (floatable platform device) 200 configured with three buoy clusters having five buoys per cluster is illustrated in the upright (FIG. 21) and retracted (FIG. 22) positions. Such a vessel (floatable platform device) could receive and depart aircraft, or spacecraft from the upper deck (platform 1'). The upper structure of the vessel could be made of materials used in high rise commercial buildings or similar to cruise ship superstructures. Such a vessel would provide occupants with a low motion environment for conduct of onboard activities. This vessel could be useful for touring in comfort, or to host a variety of activities such as, medical facilities, manufacturing or maintenance, military surveillance, oil exploration, nautical research, search and rescue basing, and many more.

The upper decks or platforms shown in the Figures are of simple geometric shapes but by no means should this imply a restriction of the possible shapes and functions of the upper platform. The platform may have at least three pivot attachments to the footings and be of sufficient size and strength to survive the marine environment. After this has been achieved any shape imaginable is possible. Very tall structures may lead to decreased stability and increased sensitivity to wind.

In order to provide a sense of scale the following table lists the properties of vessels based on the diameter of the buoys. All features of the vessel are increased by the same amount. (A buoy with twice the diameter will generally be twice as long). All vessels in the table have the same spar buoy length to diameter ratio, which may be changed to adjust the natural oscillation period.

| Buoy Diameter | Useful Load, Metric Tons (Structure and Payload) | Draft Fully Loaded Deployed/Retracted | Natural Period |
|---|---|---|---|
| 1 meter | 22 to 30 | 8.5 to 11/1.8 meters | 5.0 to 5.2 seconds |
| 2 meters | 174 to 242 | 17 to 22/3.6 meters | 7.3 to 7.4 seconds |
| 5 meters | 2,700 to 3,774 | 43 to 55/8.9 meters | 11.5 to 11.7 seconds |
| 10 meters | 21,700 to 30,118 | 85 to 110/18 meters | 16.4 to 16.6 seconds |
| 20 meters | 174,000 to 2,41510 | 170 to 220/36 meters | 23 to 23.5 seconds |

Vessels of all sizes and load capacity may be created to any speciation. A vessel as in FIG. 21, with buoys between 2 and 5 meters in diameter could safely be deployed in the Gulf of Mexico, the Mediterranean, or any of Earth's large lakes. A vessel with buoys 20 meters in diameter should be able to withstand any condition seen in the Atlantic Ocean.

This invention may be expressed in three basic modes. The first mode is that of a passive wave isolation platform device 100 that is towed into position and anchored. This mode is the simplest form and is shown in FIG. 1. A spar buoy 4 tailored for a specific wave frequency will have a fixed load bearing capacity. To increase the total load capacity that may be supported by the platform, additional buoys may be added to each cluster and additional clusters may be added to support platform 1. This is true for all further modes described.

The second mode, such as illustrated in FIGS. 15-17, is a floatable platform device but with self-propelled capability through the addition of a wrap-around propulsion module (thruster) to one or more of the individual spar buoys in one or more of the spar buoy clusters. This mode is capable of navigating and avoiding obstacles in water of sufficient depth to remain floating. The frequency and size of the waves expected to be encountered for application on a particular body of water, will dictate the spar buoy dimensions requiring water of a particular depth to float the buoys in the vertical orientation. Large, long period waves will dictate large buoy dimensions. This could limit the vessel to deep water, and could restrict access to all but the deepest water ports. It could even limit such a vessel to remain continuously at sea if no port of sufficient depth is available.

The third mode, such as illustrated in FIGS. 21 and 22 (along with the self-propulsion thrusters of FIGS. 15-17), is a self-propelled wave isolation platform vessel 200 with the ability to transition all of the spar buoys simultaneously from vertical axis alignment to horizontal axis alignment and vice versa. In this mode, a mechanism to relocate a portion, or all, of the ballast is added to each spar buoy. The vessel is equipped with a central control able to coordinate the positions of the movable ballast on every individual buoy at the same time. In addition, the pivot connecting the buoy to the first level footing may be configured to accommodate both vertical and horizontal alignment of the buoy. Furthermore the propulsion mechanism attached to any such buoy may be configured to provide useful thrust in either vertical or horizontal alignment.

If the vessel is underway at a low speed when initiating transition, the drag of the motion through the water will help keep the buoys aligned in the same direction as they swing from vertical to horizontal or vice versa. This is in addition to the natural tendency of the buoys to tilt in the direction of the displacement of the ballast from the buoy's central axis. By keeping the buoys within a cluster oriented so that the ballasts all swing in the same direction and maintaining a small amount of velocity through the water, a gentle transition may be managed.

A vessel of this mode will have access to a greater number of ports when returning from sea or seeking safe harbor. However, with the buoys in horizontal alignment, much of the wave isolation capability will be lost. Such a vessel should only be used in the horizontal buoy alignment configuration while navigating through shallows in fair conditions.

Figure 23:
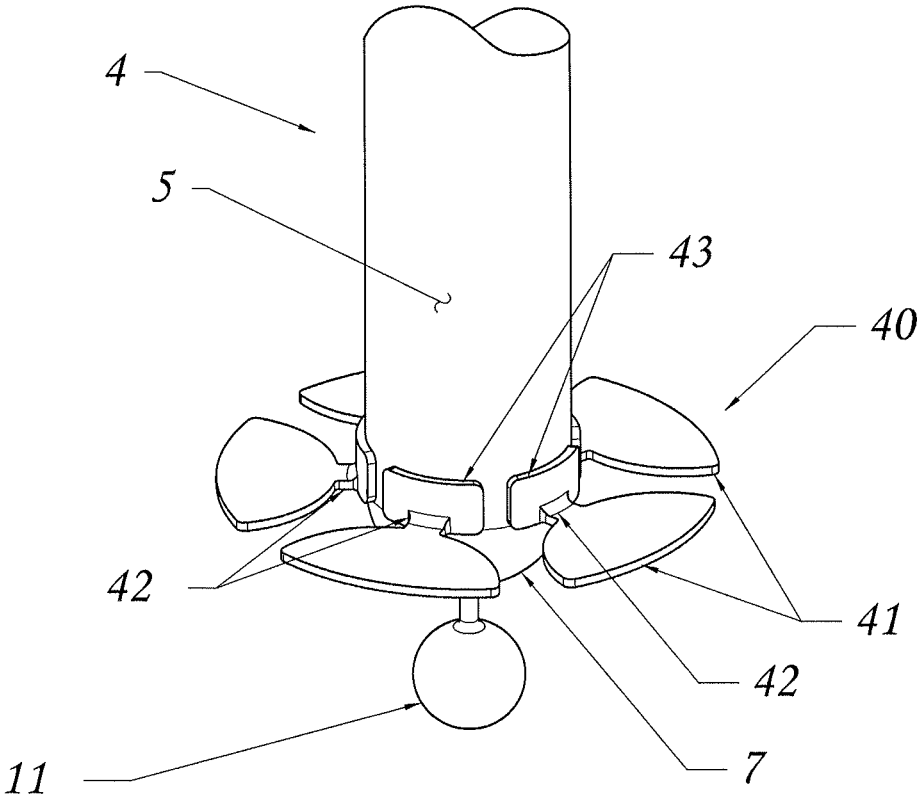
FIG. 23 is a perspective view of an optional damping fin assembly for a buoy with non moveable ballast.
Figure 24:
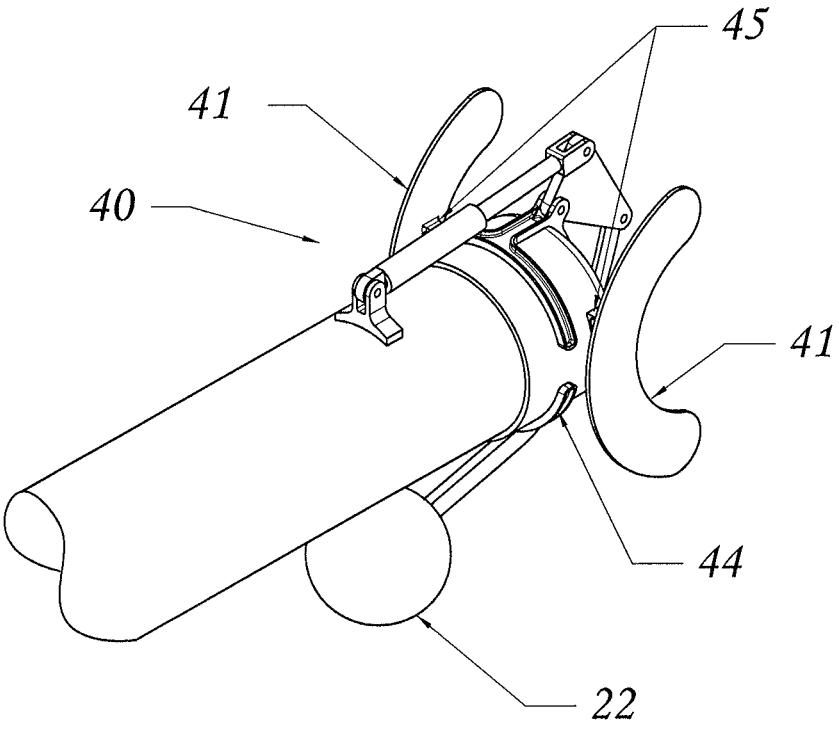
FIG. 24 is a perspective view of the damping fin assembly of FIG. 11 in the retracted position.

Referring to FIGS. 11, 23 and 24 (as well as FIGS. 1, 2, and 9), an optional damping fin assembly 40 may be added to each of the modes discussed above. Damping fin assembly 40 may be attached near each spar buoy base 7 to reduce undesired oscillations along the vertical axis. Damping fin assembly 40 includes spaced apart fins 41 that extend outwardly from a single spar buoy shell 5 near spar buoy base 7 and ballast (11, 22). The fins themselves may vary in shape as illustrated in FIGS. 11 and 24 but all include a broad surface. Each fin 41 has a rigid connection 42 to the lower end of the tubular spar buoy shell 5, which may be a plate 43 (FIGS. 1, 2, 9, 23) or a ring band 44 (FIGS. 11, 24). Depending on the application, the rigid connection may include a hinge 45 that may allow for fin retraction, particularly where combined with moveable ballast 22 as illustrated in FIGS. 11 and 24.

When ambient wave periods are within 1.7 times the natural bob period of the supporting spar buoys, the footings and platform will begin to respond and oscillate due to the motion of waves. The nearer the wave period is to being equal to the bob period, the more pronounced the response will be. This is when the damping fin assembly is useful to providing a comfortable, stable environment on the platform.

The depth of the bottom end of the buoys will typically, and by design, lie below the depth at which water is disturbed by the motion of surface waves. This allows a damping fin placed at the low end of the spar buoy to be most effective. Each fin's broad surface lies perpendicular to its corresponding spar buoy's vertical axis. With enough surface area, the damping fin assembly will resist oscillation along the vertical axis induced by waves of similar period to the nature bob period of the spar buoy.

On a transitioning spar buoy equipped with a damping fin assembly, hinge 45 (FIGS. 11 and 24) may allow alignment of the fins in the direction of travel when the vessel spar buoy clusters are in the horizontal position.

Advantages of the invention tailors the natural frequency of the spar buoys to provide minimal response to the actions of waves on the body of water for which it is intended. It further can employ multiple levels of articulation for the purpose of motion isolation of the upper platform for the conduct of motion sensitive operations while afloat. Clustering spar buoys under articulated footings in groups of three or more allows for a high load capacity while maintaining a tuned frequency response to the action of waves. Lateral and upward displacement of ballast, involving a lateral and upward displacement of the ballast, is useful in controlling direction the spar buoys will swing up and down while in transition. Thruster arrangement of this invention provides individual control of each buoy cluster and endows the vessel with unique modes of locomotion not seen in traditional surface ships. And the upright vessel may travel in any direction without re-orienting the platform. The retracted horizontal configuration navigates more like traditional surface vessels but has a unique appearance resembling something from science fiction.

The need to conduct motion sensitive operations at sea is increasing in the fields of space launch and recovery, oil exploration, aquaculture, international business, trade, finance, and travel and leisure. Additionally, motion isolated platforms will open possibilities for individuals to work in, or enjoy, nautical settings without the concern for motion sickness.

Many regions of the world are in need of new living space which will not increase pressure on terrestrial eco systems. The invention of a stable, robust, marine platform capable of handling the most severe wind and waves while providing occupants a low motion environment will be of tremendous value. Civil, business, research, and military uses of such a platform abound. This makes the described arrangement for supporting a stable floating platform upon spar buoy clusters using multiple levels of articulated footings unique and valuable.

The illustrated embodiments are only examples of the present invention and, therefore, are non-limitive. It is to be understood that many changes in the particular structure, materials, and features of the invention may be made without departing from the spirit and scope of the invention. Therefore, it is Applicant's intention that his patent rights not be limited by the particular embodiments illustrated and described herein, but rather by the following claims interpreted according to accepted doctrines of claim interpretation, including the Doctrine of Equivalents and Reversal of Parts.

The invention claimed is:

1. A mobile, wave motion-isolated, waterborne device comprising:

a platform having an upper and a lower surface with a plurality of support members projecting beneath the lower surface, said support members configured to receive an articulating joint;

a plurality of swivel footings, one swivel footing corresponding to one of support members, each swivel footing having a central pivot with an articulating joint that is configured to be received within the support member, each swivel footing also configured to receive a plurality of articulating joints radially spaced apart from the central pivot; and a plurality of clusters of spar buoys, wherein each cluster of spar buoys corresponds to a single swivel footing, and wherein each spar buoy includes a tubular shell, a first end having an articulated joint that is configured to be received within one of the corresponding swivel footings, and wherein each spar buoy also includes a second end that is operably connected to a ballast.

2. The device according to claim 1 wherein the swivel footing includes a plurality of arms having a first end that is operably connected to the central pivot and a second end that is configured to receive an articulating joint.

3. The device according to claim 1 wherein the ballast is moveable that is configured to transition between a vertical floating position and a horizontal position including a lever arm mechanism attached to the ballast that is configured to move about a pivot point.

4. The device according to claim 1 further comprising a propulsion module configured to attach around a spar buoy without penetrating the tubular shell, said module having a housing, an impeller positioned within the housing, and one or more nozzles.

5. The device according to claim 4 wherein each nozzle is positioned partially circumferentially about the tubular shell of the spar buoy and wherein each nozzle is configured to articulate through an angle of 90 degrees.

6. The device according to claim 1 further comprising a steering mechanism.

7. The device according to claim 1 further comprising one or more levels of articulation between the clusters of spar buoys and the support members of the platform.

8. The device according to claim 1 further comprising a damping assembly configured to be operably connected to a second end of at least one spar buoy per cluster.

9. A mobile, wave motion-isolated, waterborne device comprising:

a platform having an upper and a lower surface with a plurality of support members projecting beneath and operatively connected to the lower surface of the platform;

a plurality of swivel footings wherein each swivel footing includes a central hub and radially spaced out access points, and wherein one swivel footing corresponds to one of the support members;

a plurality of clusters of spar buoys, wherein each cluster of spar buoys corresponds to a single swivel footing, and wherein each spar buoy includes a tubular shell, a first end, and a second end that is operably connected to a ballast;

articulating joint means between the central hub of each swivel footing and its corresponding support member; and articulating joint means between the radially spaced out access points of each swivel footing and the first ends of a spar buoys in a corresponding cluster.

10. The device according to claim 9 wherein the articulating joint means comprises a ball and socket joint, a universal joint, a gimbal joint, or a spherical bearing joint.

11. The device according to claim 9 wherein the ballast includes pivoting movement means.

12. The device according to claim 11 wherein the swivel footing includes a plurality of arms having a first end that is operably connected to a central pivot and a second end that is configured to receive an articulating joint.

13. The device according to claim 9 further comprising propulsion means.

14. The device according to claim 9 further comprising steering means.

15. The device according to claim 13 wherein the propulsion means further comprises a propulsion module configured to attach around a spar buoy without penetrating the tubular shell, said module having a housing, an impeller positioned within the housing, and one or more nozzles.

16. The device according to claim 9 further comprising a damping assembly configured to be operably connected to the second end of at least one spar buoy per cluster.

17. A mobile, wave motion-isolated, waterborne vessel comprising:

a platform having an upper and a lower surface with a plurality of support members projecting beneath the lower surface, said support members configured to receive an articulating joint;

a plurality of swivel footings, one swivel footing corresponding to one of the support members, each swivel footing having a central pivot with an articulating joint that is configured to be received within the support member, each swivel footing also configured to receive a plurality of articulating joints radially spaced apart from the central pivot; and a plurality of clusters of spar buoys, wherein each cluster of spar buoys corresponds to a single swivel footing, and wherein each spar buoy includes a tubular shell, a first end having an articulated joint that is configured to be received within one of the corresponding swivel footings, and wherein each spar buoy also includes a second end that is operably connected to a ballast;

wherein each ballast is moveable that is configured to transition between a vertical floating position and a horizontal position including a lever arm mechanism attached to the ballast that is configured to move about a pivot point; and a propulsion module configured to attach around a spar buoy without penetrating the tubular shell, said module having a housing, an impeller positioned within the housing, and one or more nozzles.

18. The vessel according to claim 17 wherein the ballast is moveable that is configured to transition between a vertical floating position and a horizontal position including a lever arm mechanism attached to the ballast that is configured to move about a pivot point.

19. The vessel according to claim 17 further comprising a steering mechanism that is configured to be operably connected to each cluster.

20. The vessel according to claim 17 further comprising a damping assembly configured to be operably connected to the second end of at least one spar buoy per cluster.

* * * * *